US011697935B2

(12) United States Patent
Cullen

(10) Patent No.: US 11,697,935 B2
(45) Date of Patent: Jul. 11, 2023

(54) ROOFING AND WALL SYSTEMS AND BATTEN-EQUIPPED, FOIL-LAMINATED, INTERNALLY DRAINABLE INSULATION PANELS FOR SAME

(71) Applicant: Bernard Ted Cullen, Winnipeg (CA)

(72) Inventor: Bernard Ted Cullen, Winnipeg (CA)

(73) Assignee: Quik-Therm Insulation Solutions Inc., Winnipeg (CA)

( * ) Notice: Subject to any disclaimer, the term of this patent is extended or adjusted under 35 U.S.C. 154(b) by 294 days.

(21) Appl. No.: 17/091,067

(22) Filed: Nov. 6, 2020

(65) Prior Publication Data

US 2021/0131094 A1 May 6, 2021

Related U.S. Application Data

(60) Provisional application No. 62/931,718, filed on Nov. 6, 2019.

(51) Int. Cl.

| | |
|---|---|
| ***E04B 1/80*** | (2006.01) |
| ***E04B 1/76*** | (2006.01) |
| ***E04D 13/16*** | (2006.01) |

(52) U.S. Cl.

CPC ..... *E04B 1/80* (2013.01); *E04B 1/7612* (2013.01); *E04B 1/7637* (2013.01); *E04D 13/165* (2013.01)

(58) Field of Classification Search

None

See application file for complete search history.

(56) References Cited

U.S. PATENT DOCUMENTS

| | | | | |
|---|---|---|---|---|
| 2,007,374 A * | 7/1935 | Kuehne | E04B 1/82 | 52/145 |
| 4,073,991 A * | 2/1978 | Focht | B32B 15/046 | 296/210 |
| 5,088,259 A * | 2/1992 | Myers | E04D 11/02 | 52/410 |
| 5,584,153 A * | 12/1996 | Nunley | E04D 13/165 | 52/552 |
| 6,256,957 B1 * | 7/2001 | Kelly | E04D 11/02 | 52/309.3 |
| 10,094,113 B2 * | 10/2018 | Hill | E04B 1/80 | |
| 2003/0033769 A1 * | 2/2003 | Record | E04B 1/14 | 52/270 |

(Continued)

*Primary Examiner* — Joshua K Ihezie

(74) *Attorney, Agent, or Firm* — Kyle R Satterthwaite; Ryan W Dupuis; Ade & Company Inc.

(57) ABSTRACT

Insulation panels for wall construction and roofing installation are characterized by inlaid battens in outer faces thereof by which multiple layers of insulation can be installed without thermal bridging. Second and any subsequent layers are each fastened only to the battens of the immediately underlying layer, without fully penetrating therethrough to the roof deck, building wrap or other substrate. Laminated facers of perforated character allow migration of moisture to and from a foam core of the panel, while internal channels and internal slots beneath the facer enable drainage/drying of excess moisture without material degradation of the inlaid battens. Additional drainage space within each layer is provided at inter-panel connections, where tongue and groove connections are configured to leave such drainage space open between the tongue and groove.

10 Claims, 6 Drawing Sheets

(56) References Cited

U.S. PATENT DOCUMENTS

2004/0109983 A1* 6/2004 Rotter ..... B32B 5/32 428/317.1
2006/0191223 A1* 8/2006 Bontrager ..... E04D 13/1618 52/411
2007/0193157 A1* 8/2007 Kelly ..... E04D 11/02 52/309.8
2007/0294976 A1* 12/2007 Fay ..... E04B 1/0046 52/515
2010/0095621 A1* 4/2010 Pumper ..... E04B 1/80 52/762
2011/0036030 A1* 2/2011 Hegland ..... E04B 1/26 52/309.4
2011/0047908 A1* 3/2011 Brusman ..... E04C 2/22 52/800.1
2012/0047837 A1* 3/2012 Schaefer ..... E04F 13/148 52/519
2012/0174503 A1* 7/2012 Milostic ..... E04B 2/7409 52/480
2012/0174511 A1* 7/2012 Harding ..... E04F 21/18 294/93
2013/0067838 A1* 3/2013 Black ..... E04B 1/80 52/794.1
2013/0152498 A1* 6/2013 Krause ..... E04F 13/0821 52/235
2016/0130820 A1* 5/2016 Cullen ..... E04B 2/02 52/745.1
2016/0201346 A1* 7/2016 Nunley ..... E04G 23/0218 52/745.21
2018/0038109 A1* 2/2018 Kennedy ..... E04D 3/352
2019/0061313 A1* 2/2019 Yao ..... E04B 1/80
2019/0077700 A1* 3/2019 Xu ..... C04B 26/28
2019/0360216 A1* 11/2019 Hayes ..... E01C 3/006
2020/0141118 A1* 5/2020 Kreizinger ..... B32B 27/40
2021/0207378 A1* 7/2021 Dzenis ..... B32B 7/12

* cited by examiner

ROOFING AND WALL SYSTEMS AND BATTEN-EQUIPPED, FOIL-LAMINATED, INTERNALLY DRAINABLE INSULATION PANELS FOR SAME

CROSS-REFERENCE TO RELATED APPLICATIONS

This application claims benefit under 35 USC 119(e) of U.S. Provisional Patent Application No. 62/931,718, filed Nov. 6, 2019.

FIELD OF THE INVENTION

The present invention relates generally to insulated roofing and wall assemblies for energy efficient building construction.

BACKGROUND

More than ever, there is a demand for building construction techniques with improved thermal performance to reduce energy consumption associated with climate control of the building interior. With this in mind, Applicant has designed novel systems for construction of insulated roofs and walls.

SUMMARY OF THE INVENTION

According to a first aspect of the invention there is provided a roof or wall assembly comprising:

a substrate;

a first layer of foam insulation panels laid out over said substrate, said first layer of foam insulation panels comprising a first set of foam cores in which there are inlaid a first set of battens at outer sides of said first set of foam cores that face oppositely of said substrate;

a second layer of foam insulation panels laid out over said first layer of foam insulation panels, said second layer of foam insulation panels comprising a second set of foam cores in which there are inlaid a second set of battens at outer sides of said second set of foam cores that face oppositely of said substrate;

a first set of fasteners penetrating inwardly through the first layer of foam insulation panels from the outer sides thereof at positions penetrating through the first set of battens and into to the substrate, thereby fastening said first layer of foam insulation panels to said substrate;

a second set of fasteners penetrating inwardly through the second layer of foam insulation panels from the outer sides thereof at positions penetrating through the second set of battens and into the first set of battens, without penetrating fully through said first layer of foam insulation panels, thereby fastening the second layer of foam insulation panels to the first layer of foam insulation panels;

whereby neither set of fasteners penetrates both layers of foam insulation panels, thereby avoiding thermal bridging through said layers.

Preferably the foam insulation panels in at least one of said layers further comprise outer facers that span the outer sides of the foam cores, and thereby cover said battens.

Preferably the foam insulation panels of at least one of said layers comprises drainage channels recessed in one or both of the outer side of the insulation panels and an opposing underside thereof.

The substrate may comprise a corrugated layer, in which case the first set of fasteners are preferably longer than the second set of fasteners so that each fastener of the first set penetrates the corrugated layer of the substrate regardless whether said fastener penetrates said corrugated layer at a valley or land thereof.

According to a second aspect of the invention there is provided a roofing or wall system comprising:

a first set of foam insulation panels having a first set of elongated battens inlaid in foam cores of said first set of foam insulation panels at primary faces thereof, said first set of foam insulation panels being placeable in a first layer over a substrate in an orientation in which said primary faces face outwardly away from said substrate to place said first set of elongated battens at an outer side of said first layer;

a second set of foam insulation panels having a second set of elongated battens inlaid in foam cores of said second set of foam insulation panels at primary faces thereof, said second set of foam insulation panels being placeable over the substrate in a second layer overlying the first layer in an orientation in which said primary faces of the second set of foam insulation panels face outwardly away from said first layer to place said second set of elongated battens at an outer side of said second layer;

a first set of fasteners having a first length sufficient to penetrate inwardly through the first layer of foam insulation panels from the outer side thereof at positions penetrating through the first set of battens into to the substrate, thereby fastening said first layer of foam insulation panels to said substrate;

a second set of fasteners having a second length configured to penetrate inwardly through the second layer of foam insulation panels from the outer thereof at positions penetrating through the first and second sets of battens without penetrating fully through said first layer of foam insulation panels, thereby fastening the second layer of foam insulation panels to the first layer of foam insulation panels;

whereby neither set of fasteners will penetrate both layers of foam insulation panels, thereby avoiding thermal bridging through said layers.

Preferably the foam insulation panels of both of said layers comprise said outer facers.

Preferably the foam insulation panels in at least one of said layers further comprise inner facers that also span the foam cores at opposing inner sides thereof.

Preferably both of said layers comprise said inner facers.

Preferably each facer comprises a metalized polymer film.

Preferably each facer is a perforated facer.

Preferably each perforated facer comprises openings therein through which moisture is migratable into the foam core.

Preferably each perforated facer has an average perforation diameter of no more than ⅛-inch.

Preferably each perforated facer has an average perforation diameter of no less than 1/64-inch.

Preferably each perforated facer has an average perforation diameter of between 1/32-inch and 1/16-inch, inclusive.

Preferably a perforated area of each perforated facer is no more than 3% of a total overall area of said facer.

In one instance, the perforated area of each perforated facer is no more than 2% of a total overall area of said facer.

In one instance, the perforated area of each perforated facer is between 1 and 2% of a total overall area of said facer.

In one instance, the perforated area of each perforated facer is approximately 1% of a total overall area of said facer.

In another instance, the perforated area of each perforated facer is approximately 1.5% of a total overall area of said facer.

For roofing applications, there may be provided clips mounted over an outermost layer of foam insulation panels to hold metal roof cladding thereatop, said clips being fastened to an outermost set of battens inlaid in foam cores of said outermost layer of insulation panels at an outer side of said foam cores.

Said clips may be fastened to said outermost set of battens by a third set of fasteners, which preferably penetrate into or through said outermost set of battens without fully penetrating said outermost layer of foam insulation panels.

Said outermost layer of insulation panels may be the second layer of foam insulation panels.

According to a third aspect of the invention there is provided a roof or wall assembly comprising:

a substrate;

a first layer of foam insulation panels laid out over said substrate, said first layer of foam insulation panels comprising a first set of foam cores in which there are inlaid a first set of battens at outer sides of said first set of foam cores that face oppositely of said substrate;

a second layer of foam insulation panels laid out over said first layer of foam insulation panels, said second layer of foam insulation panels comprising a second set of foam cores in which there are inlaid a second set of battens at outer sides of said second set of foam cores that face oppositely of said substrate;

wherein the foam insulation panels in at least one of said layers further comprise laminated outer facers that span the outer sides of the foam cores, and thereby cover said battens.

According to a fourth aspect of the invention there is provided a roof assembly comprising:

a roof deck;

a first layer of foam insulation panels laid out over said roof deck;

a second layer of foam insulation panels laid out over said first layer of foam insulation panels;

wherein the foam insulation panels of at least one of said layers comprises drainage channels recessed in at least one of the topside or an opposing underside thereof.

According to a fifth aspect of the invention there is provided a roof assembly comprising:

a roof deck;

one or more layers of foam insulation panels laid out over said roof deck, of which at least a topmost of said layers comprises a respective set of elongated battens inlaid in foam cores of said insulation panels at a topside of said foam cores; and clips mounted atop said topmost layer of foam insulation panels to hold metal roof cladding thereatop, said clips being fastened to the respective set of battens in said topmost layer.

According to a sixth aspect of the invention there is provided a foam insulation panel comprising:

a foam core with two primary faces and a plurality of perimeter edges joining together said two primary faces;

one of said two primary faces having inlaid therein at least one elongated batten;

a laminated facer applied over said one of said two primary faces and said at least one elongated batten inlaid therein;

on at least one side of said elongated batten, an open gap left between the foam core and the laminated facer and running longitudinally alongside said elongated batten, thereby creating an internal drying and/or drainage channel beneath said laminated facer.

Said elongated batten may be only partially recessed into the foam core, and thus may protrude slightly outward from the primary face in which it is inlaid According to a seventh aspect of the invention there is provided a foam insulation panel comprising:

a foam core with two primary faces and a plurality of perimeter edges joining together said two primary faces, of which a first perimeter edge and a second perimeter edge lie parallel and opposite to one another a groove recessed in and running along said first perimeter edge; and a tongue protruding from and running said second perimeter edge;

wherein said groove and said tongue are sized and shaped to admit insertion of said tongue of said panel into said groove of a second like panel to mate said panels together, but also sized and shaped such that the tongue of the panel occupies less than an entirety of groove of said second like panel to leave an open air space between a boundary wall of the groove and a boundary surface of the tongue that forms an inter-panel drying/drainage channel between said panels.

Preferably a recessed depth of said groove from said first perimeter edge exceeds a protruding height of said tongue from the second perimeter edge, such that when said panels are fully mated together with the tongue of the panel at a maximum penetration depth into the groove of the second like panel, said air space is left open between an outermost tip of the tongue and an innermost floor of the groove.

According to an eighth aspect of the invention there is provided a foam insulation panel comprising:

a foam core with first and second primary faces and a plurality of perimeter edges joining together said first and second primary faces;

a first laminated facer applied over said first primary face;

beneath said first laminated facer, a set of drainage slots recessed into the foam core at the first primary face thereof at spaced intervals thereacross;

wherein the first laminated facer spans across each drainage slot in spaced non-conforming relation thereover to leave open airspace between the foam core and the first laminated facer within said drainage slot.

BRIEF DESCRIPTION OF THE DRAWINGS

Preferred embodiments of the invention will now be described in conjunction with the accompanying drawings in which.

DETAILED DESCRIPTION

Figure 1:
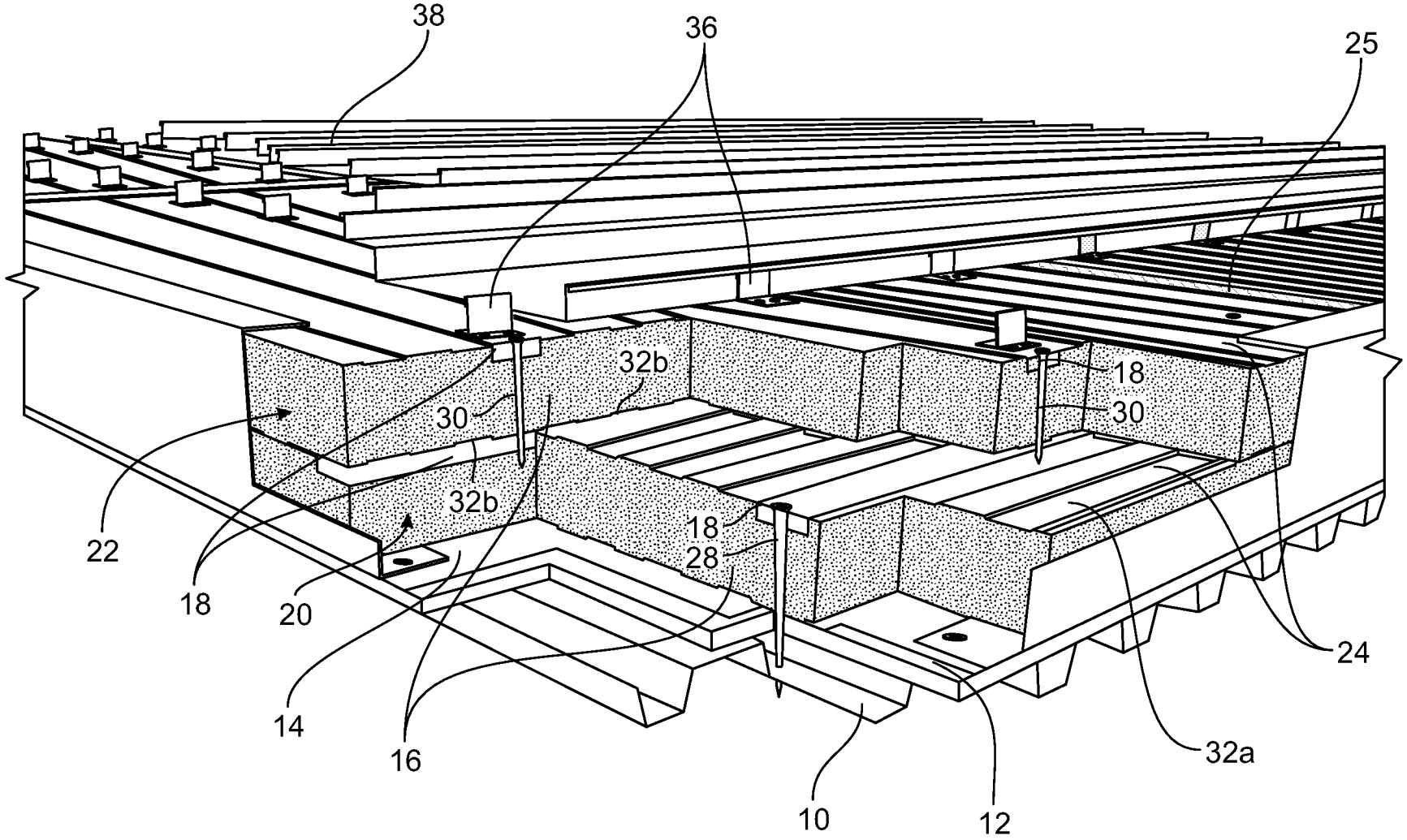
FIG. 1 is a partially cut away illustration of an installed roof assembly of the present invention.

FIG. 1 illustrates one non-limiting embodiment of roofing system of the present invention. In the illustrated example, the roof system is installed atop a metal roof deck that comprises corrugated metal sheeting 10 sheathed with an overlying layer of exterior gypsum board 12, subsequently covered with flexible polymeric sheeting or other type of air/vapour barrier 14, though the system may alternatively be used on a wooden roof deck instead of a corrugated metal roof deck. The primary components of the system are rigid foam insulation panels whose foam cores 16 have inlaid therein, at one of the two primary faces thereof, elongated battens 18 of wood or other material of greater rigidity than the foam core 16 itself, which may for example be composed of expanded polystyrene (EPS), though other known rigid foam insulation materials may alternatively be used. The insulation panels are laid down atop the roof deck in two layers 20, 22, in batten-up orientations in which the batten-inlaid primary face of the panel's foam core faces upwardly away from the roof deck, whereby the inlaid battens 18 reside at the topsides of the insulation panels in each layer. Each batten 18 spans an entire lengthwise dimension of each panel from one perimeter edge to an opposing perimeter edge thereof, and the two layers of insulation panels are laid out with their lengthwise dimensions oriented perpendicularly transverse to one another.

Accordingly, the battens 18 in the first layer 20 of insulation panels laid atop the roof deck lie at right angles to the battens in the second layer of insulation panels laid atop the first layer. More particularly, in the example of a sloped roof, the lengthwise direction of each insulation panel in the first layer may be laid in the slope direction of the roof, whereby the battens 18 of the first layer 20 lie parallel to the slope direction of the roof, and the battens 18 of the second layer 22 lie perpendicular thereto. While the first illustrated embodiment features two layers of insulation panels, the number of layers may be increased, with the lengthwise orientation of the panels being laid out in alternating fashion so that the battens of any two adjacent layers lie perpendicularly transverse to one another.

Each insulation panel 14 is fully laminated on both of its two primary faces with a facer of metalized polymeric film 24, whereby the topside and opposing underside of each installed insulation panel in the roofing assembly are fully spanned by respective top and bottom facers that that reflect radiant heat energy, and prevent exposure of the foam cores 16 to excessive moisture. During manufacture of the insulation panels, the battens 18 are recessed into elongated rectangular slots in the foam cores 16 before application of the facers 24, whereby the full continuous span of the laminated facer 24 over the entire face of the foam core 16 thus covers the inlaid battens 18, thereby fully embedding the battens internally within the finished insulation panel 14. At joints where the adjacent insulation panels in a given layer meet one another, preferably in a tongue-and-groove fashion along lengthwise perimeter edges thereof, a suitable sealant tape 25 is employed to seam the adjacent insulation panels together to prevent moisture penetration therebetween. The inclusion of the facers 24 improves the bonding action of such sealant tape compared to direct bonding of such tape to the bare foam of conventional facer-less rigid insulation panels, whereby this stronger bond improves the weather integrity of the finished roof assembly. The weather integrity of the installed roof assembly is further enhanced by protection of the battens 18 from excessive moisture by the laminated facers 24 spanning over the embedded positions of the battens.

A first set of fasteners 28 are used to anchor the first layer 20 of insulation panels to the underlying roof deck. Each fastener 28 of this first set is driven through a first-layer insulation panel at one of the embedded battens thereof, and is long enough to penetrate fully through the first layer into the underlying roof deck 10, whether or not the selected position of that fastener overlies a land or valley of the corrugated deck sheeting (if used). That is, the length of each fastener of the first set 28 exceeds the sum of the thickness of the first-layer insulation panel, the depth of the corrugated deck sheeting 10 and the thickness of the gypsum or other sheathing layer 12 sandwiched between the deck sheeting 10 and the first insulation layer.

A second set of fasteners 30 are used to anchor the second layer 22 of insulation panels to the fastened-down first layer 20 of insulation panels, but without penetrating through the first layer into the roof deck 10. Instead, each fastener 30 of the second set is driven through a second-layer insulation panel at one of the embedded battens 18 thereof and into or through and underlying one of the embedded battens 18 in an underlying first-layer insulation panel, but without penetrating fully through the foam core 16 and bottom facer of that first-layer insulation panel. The second set of fasteners 30 are thus shorter than the first set of fasteners 28, each having a length that only slightly exceeds the thickness of the second-layer insulation panels, which are preferably identical to the first-layer insulation panels. Preferably, the length of the second fasteners slightly exceeds the sum of the thickness of a second-layer insulation panel plus the thickness of one first-layer batten. This way, the second fasteners 30 will penetrate fully through the battens 18 in the first layer 20 of insulation panels, but only slightly, thus terminating nearer to the topside of the first insulation layer 20 than to the deck-adjacent underside thereof.

Each set of fasteners 28, 30 thus fully penetrates only one of the two insulation layers 20, 22, thus avoiding thermal bridging that would occur with longer fasteners that penetrate both layers of insulation. If more than two layers of insulation panels are applied, then the shorter fasteners 30 are again used to fasten the third and any subsequent layer of insulation panels through the battens thereof, into the battens of the second or other immediately-underlying layer, without fully penetrating this underlying layer. This process can be repeated according to the desired number of insulation layers, each time using the shorter fasteners 30 to fasten the latest layer to the battens of the preceding layer without fully penetrating that preceding layer.

In the illustrated first embodiment, instead of the primary faces of each insulation panel being purely flat, lengthwise-running drainage channels 32*a*, 32*b* are recessed into both laminated faces of the panel at spaced intervals across the width dimension thereof, each thus running parallel to the battens embedded at the topside of the panel. The drainage channels of the first layer of insulation panels thus lie perpendicularly transverse to those of the second layer. These channels allow for evaporation-encouraging airflow and liquid drainage of any moisture that may manage to penetrate the final roof cladding layer installed overtop the insulation layers in the finished roof construction. In one example, the drainage channels measure 1/16-inch deep and 2-inches wide, though these measurements may vary.

Inclusion of both top and bottom drainage channels 32*a*, 32*b* on all insulation panels allows use of the same panels for both/all layers, while providing drainage at the top of both/all insulation layers, i.e. at each intermediate interface between two adjacent insulation layers and at the upper interface between the topmost insulation layer and overlying roof cladding layer; as well as at the lower deck/insulation interface beneath the bottommost first layer of insulation panels. However, in other embodiments, if different panels are used in different layers, the selection of whether to have drainage channels at the top and/or bottom face of the particular panel type used in each layer may be varied, while still ensuring evaporation/drainage space at all interfaces. In other instances, some or all panels may simply have the drainage channels on only one side thereof in all or some of the layers, though panels having only one-sided drainage may employ a deeper channel depth, e.g. 1/8-inch instead of the 1/16-inch example given above for the illustrated first embodiment with drainage channels on the both sides. In the illustrated first embodiment with double-sided drainage on every panel, the effective channel depth is doubled at intersection areas where the bottom drainage channels 32*b* of the second layer cross over the top drainage channels 32*a* of the first layer.

The insulation panels of the first layer are laid in staggered fashion, and the panels of the second layer are likewise laid out in staggered fashion in an on-the-go manner during laying of the first layer, as opposed to laying the entirety of the first layer before starting the second layer. Though concealed under the top facer 24, the battens 18 of each insulation panel 14 are visually detectable due to tactile difference in the exterior surface of the facer that results from the lamination thereof onto the bubble-textured foam surface of the foam core vs. the smooth planar facial surface of the inlaid batten 18. Therefore, the facer has a strip like-area of smooth planar finish where it overlies each batten 18, versus a bubbly or dimpled texture that exits over the foam-laid remainder of the panel's face.

The battens 18 are inlaid at uniformly spaced intervals in the width direction of each insulation panel, for example at 16-inch intervals, and the facers may be marked with grid lines 34 useful as a visual guide as to where the battens of the second layer will cross over the battens of the first layer, thus denoting a suitable fastening point at which to drive a fastener 30 through a second-layer batten into a first-layer batten. The grid lines 34 may be drawn at a grid-spacing of higher resolution than the batten spacing, preferably at interval equal to an even-number division of the batten spacing, for example at an 8-inch grid spacing for the aforementioned 16-inch batten spacing.

Each heat-reflective facer 24, 26 may be a uniformly intact and continuous span of metalized polymer film or other substantially vapour impermeable material over the entire surface area thereof. Alternatively, each facer may instead be a perforated sheet of such metalized polymer film or other substantially vapour impermeable material having small pore-like holes or openings therein to increase the overall vapour permeability of the facer. This enables some degree of moisture to migrate into the foam core of the panel when excessive moisture conditions exist at levels inadequately overcome by drainage and evaporation rates in the drainage channels 32*a*, 32*b* alone. Such diffusion of moisture into the foam core will typically occur in a direction moving from high to low pressure; inwardly toward the building interior during warm months, and outwardly toward the outdoor environment during cold months. Once the environmental conditions have relaxed from such moisture-rich states, the foam can dry out via its exposure through the perforations to air in the drainage channels 32*a*, 32*b*. Through the use of these perforated facers, a novel approach to moisture management may be achieved, where the foam core 16 of the insulation panel 14 may be useful as a temporary moisture store when environmental conditions are at particularly elevated moisture levels. Meanwhile, intact (unperforated) areas of the laminated facer sheet between the perforations thereof avoid excessive saturation of the foam core 16 and inlaid battens 18.

In the illustrated first embodiment, each heat-reflective facer 24 defines the outermost layer of the insulation panel on the respective side thereof, and therefore is not overlaid by a breathable membrane or any other additional layer. Accordingly, no separate air, vapour or moisture barrier need be overlaid over the second or other topmost layer of insulation panels before installing the final roof cladding layer thereover. However, in the event that a perforated facer is used for the forgoing benefits, any additional vapour/air/moisture barrier that may nonetheless be imposed over the perforated heat-reflective facer must not only be breathable, but also moisture penetrable, for example by also being perforated, so as not to destroy the novel function of the perforated facer.

The perforated holes in the heat-reflective facers 24 are no greater than 1/8-inch diameter in some embodiments, no less than 1/64-inch in some embodiments, and more particularly between 1/32-inch and 1/16-inch in diameter, inclusive, in select embodiments. The perforated holes occupy no more than 3% of the overall area of each facer in some embodiments, no more than 2% in other particular embodiments, no less than 1% in some embodiments, between 1% and 2% in some particular embodiments, and approximately 1.5% in one particular embodiment. Other details, benefits and performances results concerning the use of such perforated facers are documented in Application U.S. Provisional Patent Application No. 62/795,465, the entirety of which is incorporated herein by reference.

Above the two or more layers of insulation panels, a final layer of metal roof cladding 38 is installed atop the second or other topmost layer of the insulation panels using clips 36 that, in a known manner, secure the roof cladding panels in place at spaced positions along upright seams thereof. In the context of the present invention, the bases of such clips 36 are specifically fastened to the battens 18 of the second or other topmost layer 22 of insulation panels using a third set of fasteners that are even shorter than the second set 30. These third fasteners penetrate into or through the battens 18 of the topmost layer of insulation panels without fully penetrating the underlying foam core of this layer, thereby avoiding thermal bridging through any one or more of the insulation layers. Instead of using these clips 36 to secure the roof cladding panels, the roof assembly may alternative feature a screw-down metal roof fastened directly to the battens of the topmost layer of insulation panels. Likewise, inventive aspects of the roof assembly may used with other types of final cladding layer, for example roof tiles.

Figure 3:
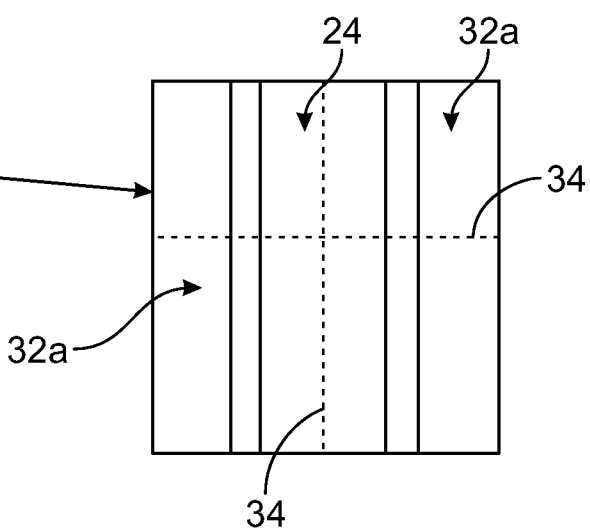
FIG. 3 is a partial overhead plan view of the one foam insulation panel of the roof assembly of FIG. 2, illustrating a laminated facer and facial drainage channels thereof.
Figure 2:
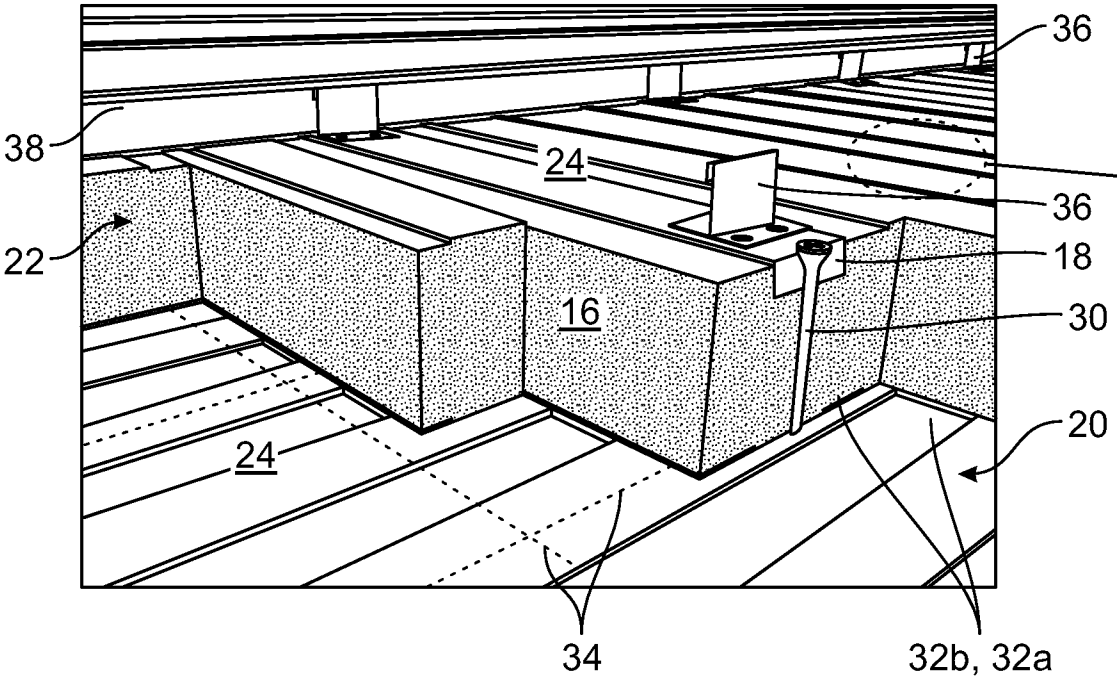
FIG. 2 is a partial closeup view of the installed roof assembly of FIG. 1.
Figure 4:
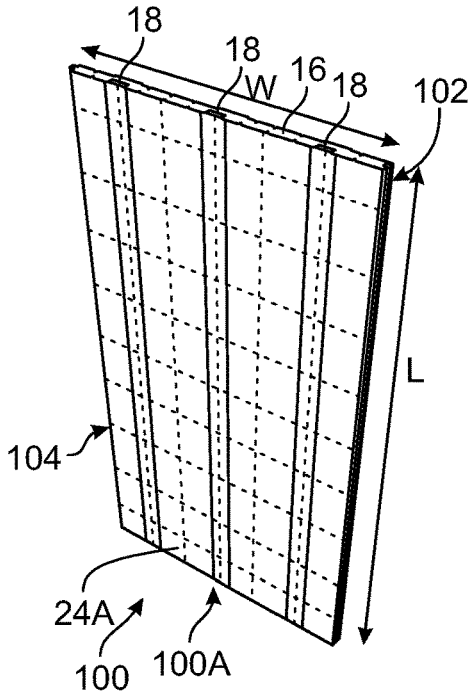
FIG. 4 is a perspective view of another rigid foam insulation panel useable in a either roof assembly like that of FIGS. 1 to 3, or a wall assembly like those show in FIGS. 10 and 11.
Figure 5:
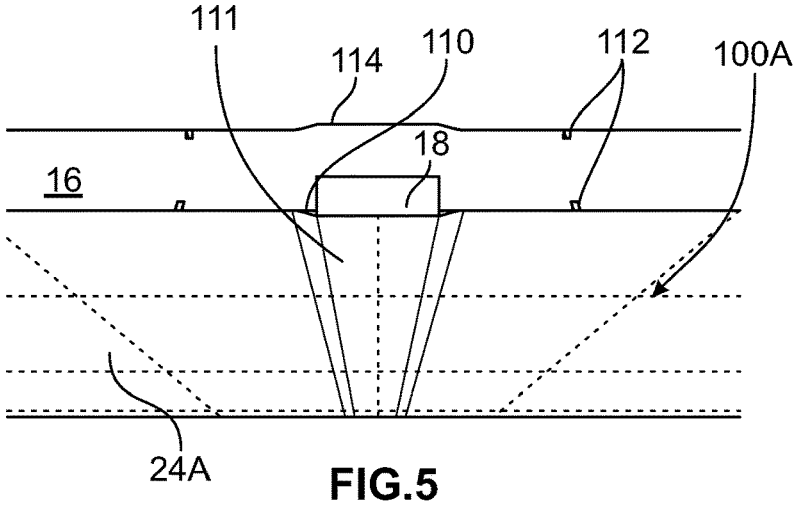
FIG. 5 is a partial close-up perspective view of the rigid foam insulation panel of FIG. 4.
Figure 6:
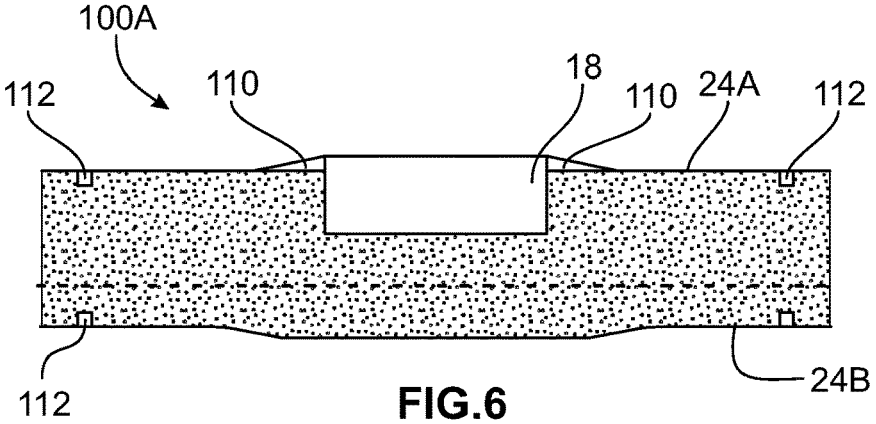
FIG. 6 is a partial close-up end view of the rigid foam insulation panel of FIGS. 4 and 5.

FIGS. 4 through 9 illustrate possible variants of the insulation panels used in the forgoing roof assembly of FIGS. 1 to 3, and incorporate additional novel features that may prove beneficial not only in the roofing context of the preceding embodiment of FIGS. 1 through 3, but also in wall constructions that make use of the same type of rigid insulation panel. As described above in relation to the insulation panels of FIGS. 1 to 3, the modified panel 100 shown in FIGS. 4 through 7 has a foam core 16 with opposing first and second primary faces of matching rectangular area that each span the length L and width W dimensions of the panel. These two primary faces collectively define a majority of the panel's surface area, the remainder of which is defined by the panel's four perimeter edges that interconnect the two primary faces around the four sides of their matching rectangular areas. In one non-limiting example, the panels measure four feet wide and eight feet long.

Figure 7:
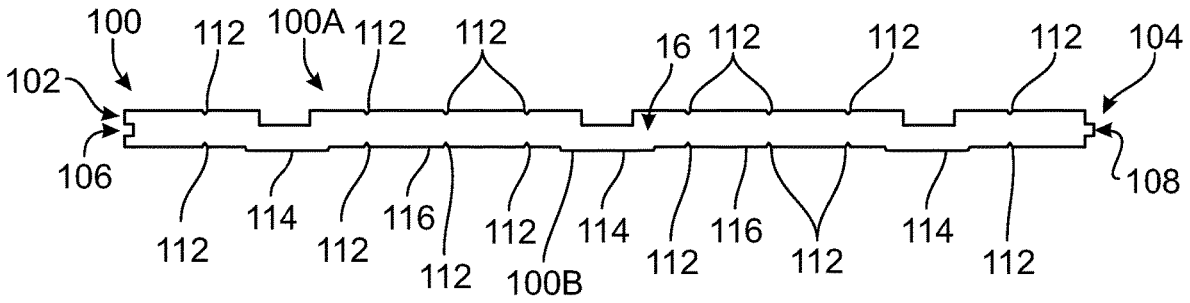
FIG. 7 is an end profile view of a foam core of the rigid foam insulation panel of FIG. 6.
Figure 8:
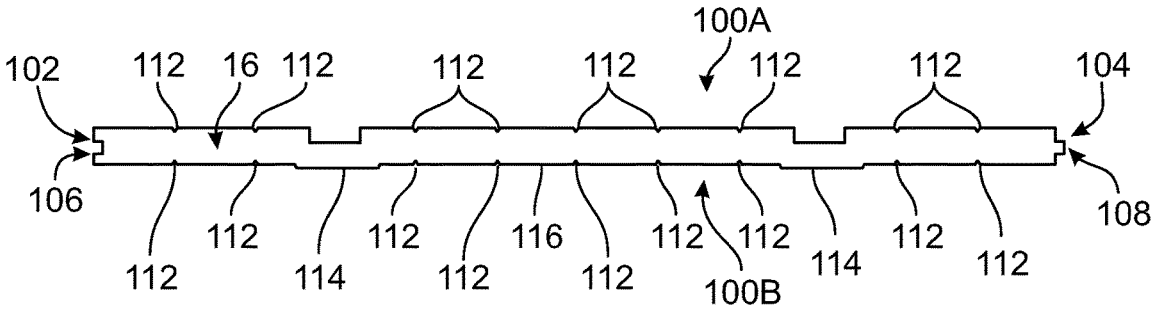
FIG. 8 is an end profile view a foam core of a variant of the rigid foam insulation panel of FIG. 6.
Figure 9:
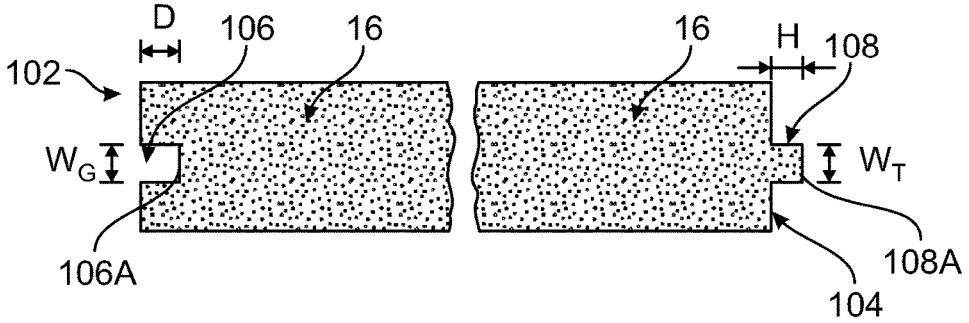
FIG. 9 is a fragmented close-up end view of the rigid foam insulation panel of FIG. 7 or 8 illustrating tongue and groove features at opposing perimeter edges of the panel for the purpose of interconnecting adjacent panels.

One of the two primary faces of the foam core 16 once again has a set of elongated battens 18 inlaid therein at spaced intervals across the width W of the panel between the two lengthwise perimeter edges 102, 104 of the panel, and each primary face is once again fully spanned by a laminated perforated facer 24A, 24B that covers both the foam core 16, and the inlaid battens 18 recessed therein. This face with the inlaid battens is referred to as an "outer face" or "outer side" of the panel's foam core 16, since it will face outwardly away from any substrate (e.g. roof deck of a roof, external building wrap of an exterior wall, etc.) over which the panel is installed during construction of a roof or wall. So, for example, in the forgoing roof context of FIGS. 1 to 3, the substrate would be the roof deck, and the outer side of the laid down panel would face upward and thus define the topside of the installed panel. As best seen in FIGS. 7 through 9, one of the two lengthwise perimeter edges 102 has a female groove 106 recessed therein over the full length dimension L of the panel, while the other lengthwise perimeter edge 104 has a male tongue 108 protruding therefrom over the full length dimension of the panel. Accordingly, the male tongue 108 of one panel is insertable into the female groove 106 of another panel to mate two adjacent panels together in edge-to-edge fashion within a shared layer of a roof or wall construction.

Further attention is now given particularly to novel features of the panel 100 that differentiate it from those described earlier with reference to FIGS. 1 to 3. In the earlier embodiment, drainage channels 32*a*, 32*b* were recessed into both faces of the panel, and the laminated facers 24 were conformingly laminated to foam core 16 over the full facial areas thereof, meaning that each such drainage channel was an external drainage channel whose floor was conformingly lined with the respective laminated facer. In the present embodiment of FIGS. 4 through 9, both sides of the panel 100 features internal drying and/or drainage features situated inside the laminated facer.

Firstly, referring to the batten-equipped outer side 100A of the panel, a respective pair of internal drying/drainage channels 110 neighbour each batten 18 on opposing sides thereof, and run longitudinally alongside the batten 18 over the full length thereof from one widthwise perimeter edge of the panel to the opposite widthwise perimeter edge. The two internal drying/drainage channels 110, best shown in FIGS. 5 and 6, both reside beneath the laminated facer 24A that spans the outer side of the panel's foam core (i.e. the "outer facer" 24A). In the illustrated example, the batten 18, instead of being fully recessed into the foam core 16 to place the outer surface of the batten flush with the outer face of the foam core 16, is only partially recessed into the foam core 16, and a relatively small fraction of the batten's thickness is left resting in a protrudingly raised or proud relationship to the neighbouring areas of the foam core's outer face 16.

Due to the slightly protruding character of the batten 18 from the foam core 16, the laminated outer facer 24A thus ramps outwardly from the planar neighbouring areas of the foam core's outer face at inclined angles thereto in order to reach the raised outer surface of the partially recessed batten. This leaves a triangular wedge-shaped gap between the laminated outer facer 24A and the foam core 16 on each side of the batten 18, thereby forming the internal drying/drainage channel 110. Any bulk water or moisture accumulated near the batten 18 will have opportunity to drain or dry through this open gap space, rather than being absorbed into the wooden batten 18, thus helping prevent any material degradation of the batten. In certain non-limiting examples, the protruding fraction of the batten thickness, and resulting depth of the internal drying/drainage channel 110, may be no more than ¼-inch, and/or no less than 1/16-inch, and may measure approximately ⅛-inch in one particular non-limiting example. A width of the internal drying/drainage channel 110 may exceed the depth thereof, and in some instances may measure more than twice the channel depth, for example measuring four times as wide in one non-limiting example of a triangular channel that measures ½-inch wide and ⅛-inch deep.

Depending on the compressibility of the foam, the batten's degree of protrusion from the foam core may be reduced when the panel is fastened through the protruding batten 18 with power tools during installation of the panel, thus potentially reducing the finished size of the drying/drainage channel 110 in the panel's installed condition, yet without fully closing off the channel in order to maintain the intended functionality thereof. To further help prevent saturation of the battens 18, the batten-overlying areas of the outer facer 24A are preferably solid unperforated areas 111 that lack the perforations found at the other perforated areas of the outer facer 24A that reside between the battens 18.

It will be appreciated that while the illustrated embodiment uses a raised/proud character of a partially recessed batten's outer surface relative to the foam core 16, and resulting ramped incline of the laminated outer facer 24A at neighbouring coplanar areas of the foam core beside the batten, to delimit internal drying/drainage channels 110 of triangular cross-section, it will be appreciated that particular shaping or non-coplanar angling of the foam core 16 at these batten-neighbouring areas thereof may additionally or alternatively be used to leave an open air gap between the foam core 16 and the outer facer 24A on one, or more preferably both, sides of the batten 18.

In addition to the internal drying/drainage channels 110 neighbouring the inlaid battens 18 on the outer side 100A of the panel 100, a set internal drainage slots 112 may also be recessed into the foam core 16 beneath the respective laminated facer 24A, 24B at one or both sides 100A, 100B of the panel. The illustrated example includes such internal drainage slots 112 on both the inner and outer sides 100A, 100B of the panel 100. The drainage slots 112 of the illustrated embodiment are oriented lengthwise of the panel, and span the full length L thereof in parallel relation to the battens 18 and the internal drying/drainage channels 110, at spaced intervals therebetween. The internal drainage slots 112 are of notably lesser width than the battens, and in non-limiting examples may have a width no more than ¼-inch, and/or no less than 1/16-inch, and for example may be approximately ⅛-inch wide in one particular non-limiting example. A depth of each drainage slot may be of comparable, though optionally different, measurement to its width, for example measuring no more than ¼-inch, and/or no less than 1/16-inch, and for example measure 3/16-inch in one particular but non-limiting instance. Due to the relatively narrow width of these slots 112, the laminated facer 24A, 24B does not conform to the narrowly-slotted profile of the foam at these pre-recessed slots 112 therein, and so the applied facer 24A, 24B instead spans in bridging fashion across the open end of the recessed slot 112, thereby encapsulating an open airspace inside each slot 112 between the foam core 16 and the laminated facer.

In the present embodiment of FIGS. 4 through 9, in addition to the internal channels 110 and internal slots 112, external drainage is also enabled on the inner side 1006 of the panel by incorporation of raised bumps 114 that span the panel 100 lengthwise at spaced intervals across the width thereof. In the illustrated examples, each raised bump 114 resides across from a respective one of the inlaid battens 18 at the outer side 100A. For example, the panel profile shown in FIGS. 4 and 7 features three inlaid battens 18 spaced at 16-inch intervals from one another across a four foot panel width, of which the two outer battens are each spaced 8-inches from a respective lengthwise edge 102, 104 of the panel so that uniform batten spacing is maintained among multiple panels when assembled together at the tongue-and-grooved lengthwise edges 102, 104 thereof. The panel variant 100' shown in FIG. 8 instead features 24-inch spacing between battens, thus having only two battens spaced apart across a four foot panel width, and each located 12-inches from a respective lengthwise edge 102, 104 of the panel. The 16-inch and 24-inch batten spacing options will accommodate most wall applications, where either 16-inch or 24-inch spacing between the framing studs of a wall's framing layer is typical, and so 16-inch or 24-inch batten spacing enables alignment of the battens in one or more layers of insulation panels to be aligned with the framing studs for fastening thereto. In the illustrated examples, the bumps 114 are spaced from one another at the same 16-inch or 24-inch intervals as the battens 18, though this need not necessarily be case, and they could, for example, be provided in double the quantity and twice the frequency of the battens, e.g. at 8-inch or 12-inch intervals.

The areas of the foam core's inner face between the bumps 114 are referred to as recessed areas 116, and except for the intermittent interruption by the internal drainage slots 112, are entirely planar in character. The laminated inner facer 24B covers the entirety of the bumps 114 and the recessed areas 116 therebetween, including the internal drainage slots 112 that are specifically located in the recessed areas between the bumps. Accordingly, when the bumps 114 of a panel being installed in a given insulation layer of a roof or deck are placed in abutment either against an underlying substrate (e.g. roof deck, building wrap, etc.), or against an underlying insulation layer of already installed panels, an empty airspace is left between the panel and the underlying insulation or substrate to leave an open drainage cavity therebetween. Unlike the internal channels 110 and internal slots 112, such drainage cavities reside in external relation to the respective facer 24B of the panel. Thought of alternatively, the recessed areas 116 between the bumps 114 are equivalent to the drainage channels 32B of the earlier roof embodiment of FIGS. 1 to 3, but are notably wider in scale.

In addition to the internal channels 110, internal slots 112 and external cavities or drainage channels, additional open airspace within an insulation layer composed of a plurality of the insulation panels 100 is created at each mating interface between two adjacent panels 100 in that layer, specifically by novel configuration of the tongue 108 and groove 106 at the opposing lengthwise edges of the panels. With reference to FIG. 9, a depth D by which the groove 106 is recessed in the respective lengthwise edge 102 of the panel's foam core 16 is made intentionally greater than a height H by which the opposing tongue 108 protrudes from its respective lengthwise edge 1104 of the panel's foam core 16. This way, when the male tongue 108 of one panel is inserted into the female tongue 106 of another panel, the tongue's reduced height H occupies only a partial fraction of the groove's depth D, thus leaving an open inter-panel air space between a boundary wall of the groove and a boundary surface of the tongue. More specifically, open airspace is left unoccupied between an outermost tip 108A of the tongue and an innermost floor 106A of the groove in a height/depth direction of the mated tongue and groove. In the illustrated example, the tongue height H measures approximately three quarters of the groove depth D. In one non-limiting example, the tongue height and the groove depth are ⅜-inch and ½-inch, respectively.

In the illustrated embodiment, a width of the tongue $W_T$ is also slightly lesser than a width of the groove $W_G$, though this difference in width is lesser than the difference in groove depth D and tongue height H. So for example, whereas a tongue height and groove depth of ⅜-inch and ½-inch, respectively, results in a gap of ⅛-inch between the tip of the tongue and the floor of the groove, the widths of the tongue and groove may differ by a smaller amount, for example a 1/16-inch difference between a 9/16-inch groove width $W_G$ and ½-inch tongue width $W_T$ in one non-limiting instance. As a result, additional open air space is left between a boundary sidewall of the groove and a lateral boundary surface of the tongue on at least one side of the tongue, though the widthwise gap measurement here is less than the tip-to-floor gap measurement owed to the height/depth difference between the tongue and groove to minimize the availability of tilt play between the two mated together panels. In other embodiments, the tongue and groove width may be more tightly conformed to optimize stability of the tongue and groove connection over the optional inclusion of widthwise air space for drying/drainage purposes.

In the illustrated embodiment, where the tongue and groove both fully and continuously span the lengthwise dimension L of the panel, the open inter-panel air space is thus a full-length drying/drainage channel spanning the full length of the two mated-together adjacent panels. It will be appreciated however that the particular sizes, shapes and relative scale of the tongue and groove may be varied, while maintaining a configuration in which the tongue occupies less than an entirety of the slot to leave an open space that forms inter-panel drainage/drying channel between the two mated-together panels.

Figure 10:
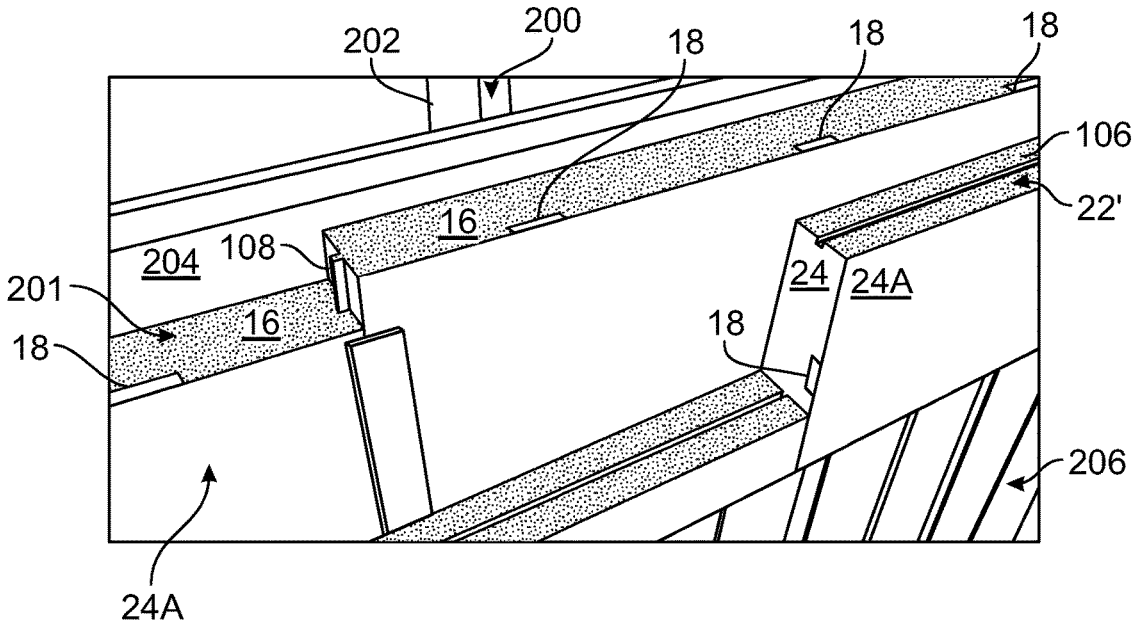
FIG. 10 is a partially cut away illustration of an erected wall assembly featuring two layers of the FIG. 7 insulation panels, with the panels of one layer oriented perpendicularly to those of the other.

FIG. 10 illustrates optional installation of two layers of the foam insulation panels 100 of the forgoing type in an externally insulated wall construction, where a framing layer 200 has a series of upright wall studs 202 delimiting internal wall cavities therebetween, and a layer of building wrap 204 is installed on an exterior side of the framing layer so as to face outwardly from the building's interior space toward the exterior outdoor environment. A first layer 20' of the insulation panels are installed with their intermittently bumped-out inner sides abutted against the building wrap, with their and with their batten-inlaid outer sides facing outwardly away from the underlying building wrap with the battens 18 oriented vertically and placed in alignment with the wall studs 22 of the underlying wall framing behind the building wrap. Grid lines 34 on the outer facers 24A of the insulation panels 100 are used to aid such alignment. The first layer of insulation panels 20' are then fastened to the studs 202 through the battens 18 of this first layer of insulation panels. In FIG. 10, a second layer 22' of insulation panels are then placed over the first layer, with the batten-inlaid outer sides thereof again residing oppositely of the underlying building wrap to face outwardly away therefrom, but are placed in perpendicular orientation to the first layer 20 so that the battens 18 of the second layer are horizontally oriented and thus lie perpendicularly cross-wise to the battens of the first layer 20'. The battens 18 in the second layer are fastened to the battens in the first layer, again optionally with the assistance of grid lines 34 on the outer facers 24A of the second layer panels, using fasteners whose lengths are appropriate to penetrate the battens 18 of the first layer 20' without piercing fully through the first layer of insulation panels. External wall cladding 206 (e.g. vinyl siding) is then installed over the outer sides of the second layer of insulation panels, and fastened the inlaid battens thereof without piercing fully through the second layer of insulation panels. The placement and fastening of the insulation layers in the FIG. 10 wall construction is thus similar to the roofing installation of FIGS. 1 to 3, except that the insulation panels are placed in vertically upstanding positions rather than horizontally laid positions, and that the substrate to which the first layer is fastened is the building wrap layer of an exterior wall construction, rather than a roof deck of a roofing installation.

Figure 11:
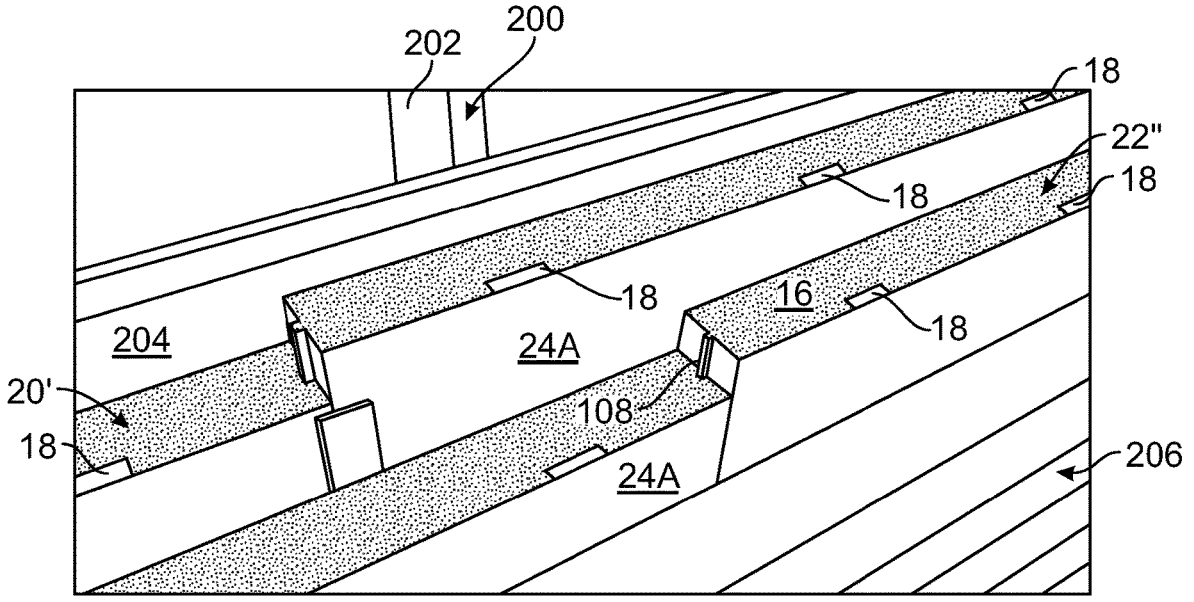
FIG. 11 is a partially cut away illustration of another erected wall assembly featuring two layers of the FIG. 7 insulation panels, but with the panels of the two layers oriented in parallel and offset relation to one another.

FIG. 11 shows a variant on the wall construction of FIG. 10, where the first layer 20' of insulation panels 100 is installed in the same fashion, but the second layer 22' of insulation panels are installed in parallel, not perpendicular, relation to the insulation panels of the first layer 20. The battens 18 in both layers thus lie vertically upright in parallel relation to the framing studs 202, though once again, only the battens of the first layer are fastened to the studs, and the battens of the second layer are fastened to those of first layer without fully penetrating panels of the first layer. Though the panels in the two layers are parallel, they are preferably horizontally offset from one another so that the tongue-and-groove inter-panel connections in one layer don't overlie the tongue-and-groove inter-panel connections in the other layer.

Figure 12:
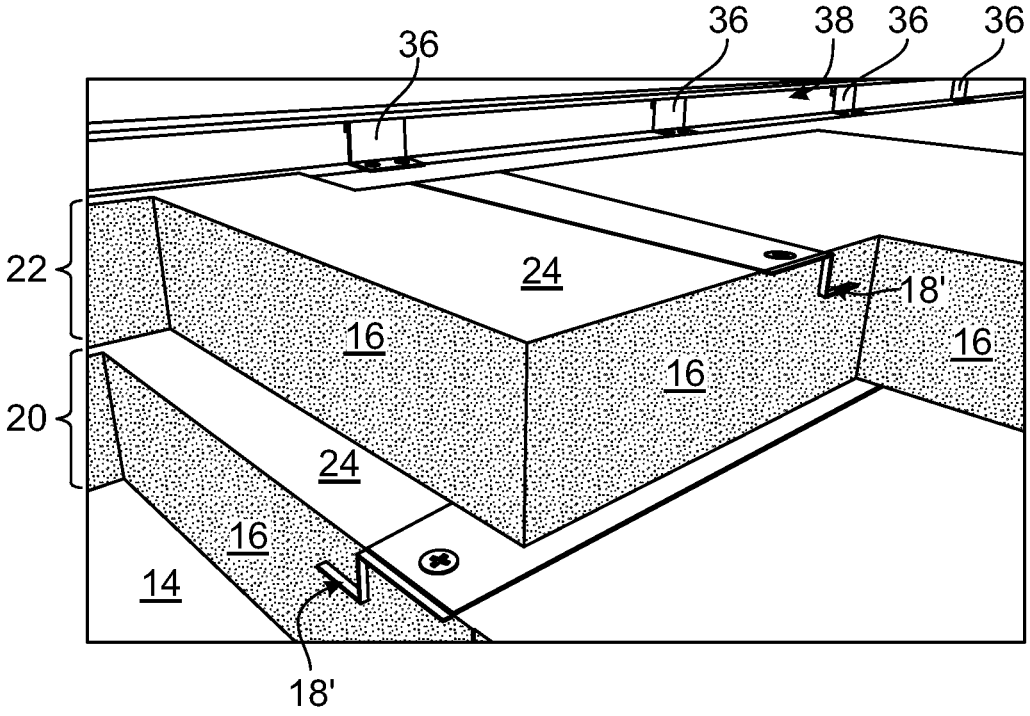
FIG. 12 is a partially cut away illustration of an installed roof assembly similar to that of FIG. 1, but illustrating optional use of metal Z-channel battens as an alternative to the flat wooden battens shown in FIG. 1.

Finally, FIG. 12 shows a variant of the roofing installation of FIGS. 1 to 3, where instead of flat strip-shaped wooden battens 18 of the type shown in the earlier figures, the inlaid battens 18' are metal channel of a Z-shaped profile. This is just one non-limiting example of a metal channel batten that may be used in any roofing or wall insulation pane of the present invention, of which another non-limiting example would be a metal channel of I-shaped profile. In either case, the parallel flanges of the channel reside in corresponding planes the faces of the wood-strip battens shown in other figures, where the outer flange nearest the outer face of the panel may reside in either flush or slightly proud/raised relation thereto, with the other flange residing in recessed relation embedded inside the foam core 16.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A roof or wall assembly comprising:

a substrate;

a first layer of foam insulation panels laid out over said substrate, said first layer of foam insulation panels comprising a first set of foam cores in which there are inlaid a first set of battens at outer sides of said first set of foam cores that face oppositely of said substrate, said first set of battens being elongated in a first direction;

a second layer of foam insulation panels laid out over said first layer of foam insulation panels, said second layer of foam insulation panels comprising a second set of foam cores in which there are inlaid a second set of battens at outer sides of said second set of foam cores that face oppositely of said substrate;

a first set of fasteners penetrating inwardly through the first layer of foam insulation panels from the outer sides thereof at positions penetrating through the first set of battens and into to the substrate, thereby fastening said first layer of foam insulation panels to said substrate;

a second set of fasteners penetrating inwardly through the second layer of foam insulation panels from the outer sides thereof at positions penetrating through the second set of battens and into the first set of battens, without penetrating fully through said first layer of foam insulation panels, thereby fastening the second layer of foam insulation panels to the first layer of foam insulation panels;

wherein:

neither set of fasteners fully penetrates both layers of foam insulation panels, thereby avoiding thermal bridging through said layers;

the foam insulation panels of both the first and second layers are of same construction and composition as one another, and each comprise a respective outer facer of polymeric film laminated directly onto a respective one of the foam cores at the outer face thereof, and also comprises a respective inner facer of polymeric film laminated directly onto said respective one of the foam cores at an opposing inner side thereof;

the first and second sets of battens are embedded battens that are overlain by the outer facers of the foam insulation panels of the first and second layers; and the first and second layers of insulation panels are sandwiched together with the inner facers of the second layer in directly abutting contact with the outer facers of the first layer at some areas thereof, while at other areas the inner facers of the second layer and the outer facers of the first layer are offset from one another to leave unoccupied drainage space therebetween that is lined by said inner facers of the second layer and said outer facers of the first layer.

2. The assembly of claim 1 wherein the foam insulation panels each comprise drainage slots recessed in at least one of the inner and outer faces of the respective foam core, and at least one of the facers of each foam insulation panel is perforated and overlies said drainage slots in a manner spanning in bridging fashion over open ends thereof in non-conforming relation to a slotted profile of the respective foam core at said drainage slots, whereby open airspaces are encapsulated within said drainage slots between the respective foam core and said at least one of the facers of polymeric film.

3. The assembly of claim 2 wherein both the inner and outer faces of the respective foam core of said each insulation panel have said drainage slots therein, and both the inner and outer facers of each insulation panel are perforated.

4. A roof or wall assembly comprising:

a substrate;

a first layer of foam insulation panels laid out over said substrate, said first layer of foam insulation panels comprising a first set of foam cores in which there are inlaid a first set of battens at outer sides of said first set of foam cores, said first set of battens being elongated in a first direction;

a second layer of foam insulation panels laid out over said first layer of foam insulation panels, said second layer of foam insulation panels comprising a second set of foam cores in which there are inlaid a second set of battens at outer sides of said second set of foam cores that face oppositely of said substrate;

wherein the foam insulation panels of both the first and second layers are of the same construction and composition as one another, and comprise laminated outer facers of polymeric film that are laminated directly onto the outer sides of the foam cores, and thereby cover said battens, and laminated inner facers of polymeric film that are laminated directly onto opposing inner sides of the foam cores, and the first and second layers of foam insulation panels are sandwiched together with the inner facers of the second layer in directly abutted contact with the outer facers of the first layer at some areas thereof, while at other areas the inner facers of the second layer and the outer facers of the first layer are offset from one another to leave unoccupied drainage space therebetween that is lined by said inner facers of the second layer and said outer facers of the first layer.

5. The assembly of claim 1 wherein each facer is a perforated facer, and the outer facers are perforated specifically at areas thereof between the battens, but unperforated at solid areas thereof that directly overlie the battens.

6. The assembly of claim 5 wherein each facer is a perforated facer, and the outer facers are perforated specifically at areas thereof between the battens, but is unperforated at solid areas thereof that directly overlie the battens.

7. The assembly of claim 2 wherein each outer facer is perforated specifically at areas thereof between the battens, but is unperforated at solid areas thereof that directly overlie the battens.

8. The assembly of claim 1 further comprising clips mounted in directly abutting contact against the outer facers of an outermost layer of foam insulation panels, which are of same construction and composition as the first layer of insulation panels, and external cladding mounted to said clips to hold metal roof cladding in place over said outermost layer, said clips being fastened to an outermost set of embedded battens inlaid in the foam cores of said outermost layer of insulation panels beneath the outer facers thereof at an outer side of said foam cores.

9. The assembly of claim 8 wherein said clips are fastened to said outermost set of battens by a third set of fasteners that penetrate into or through said outermost set of battens without fully penetrating said outermost layer of foam insulation panels.

10. A foam insulation panel comprising:

a foam core with two primary faces and a plurality of perimeter edges joining together said two primary faces;

one of said two primary faces having inlaid therein at least one elongated batten;

a perforated facer of polymeric film laminated directly onto applied over said one of said two primary faces and said at least one elongated batten inlaid therein;

wherein the perforated facer is perforated specifically at areas thereof between the battens, but is unperforated at solid areas thereof that directly overlie the battens.

* * * * *